US006797162B2

(12) United States Patent
Happel

(10) Patent No.: US 6,797,162 B2
(45) Date of Patent: Sep. 28, 2004

(54) CATCH BASIN FILTER FOR STORMWATER RUNOFF

(76) Inventor: Henry Happel, 140 Ruby St., Rockledge, FL (US) 32955

( * ) Notice: Subject to any disclaimer, the term of this patent is extended or adjusted under 35 U.S.C. 154(b) by 51 days.

(21) Appl. No.: 10/338,215

(22) Filed: Jan. 8, 2003

(65) Prior Publication Data

US 2003/0132150 A1 Jul. 17, 2003

Related U.S. Application Data

(60) Provisional application No. 60/349,053, filed on Jan. 15, 2002.

(51) Int. Cl.[7] ..... E03F 5/06

(52) U.S. Cl. ..... 210/163; 210/164; 210/266; 210/924; 404/4

(58) Field of Search ..... 210/163, 164, 210/170, 266, 282, 924, 473, 448; 404/4, 5

(56) References Cited

U.S. PATENT DOCUMENTS 783,556 A * 2/1905 Van Buskirk ..... 210/163
5,284,580 A 2/1994 Shyh
5,405,539 A * 4/1995 Schneider ..... 210/163
5,720,574 A 2/1998 Barella
5,820,762 A 10/1998 Bamer et al.
6,106,707 A 8/2000 Morris et al.
6,270,663 B1 * 8/2001 Happel ..... 210/163
6,287,459 B1 9/2001 Williamson
6,368,499 B1 4/2002 Sharpless

* cited by examiner

*Primary Examiner*—Christopher Upton
(74) *Attorney, Agent, or Firm*—William M. Hobby, III

(57) ABSTRACT

The present invention is a filter system for a curb inlet catch basin which catch basin includes a ramp in the curb front which feeds into a catch basin to allow storm water to run directly along the curb and down the ramp and which also has a grated cover so the water can enter directly through the grate. The water collecting trough is mounted inside the curb inlet catch basin at the bottom of the entrance ramp and has raised walls for collecting runoff water. A weir is formed into one of the raised walls allowing the water to run out of the trough. An elongated hydrocarbon collecting boom is removably attached adjacent the weir and positioned for the drain water passing through the weir to pass thereover. The catch basin is removably mounted to the trough adjacent the weir and positioned to receive water runoff from the trough through the weir and over the hydrocarbon collecting boom. The catch basket has a bottom filter screen and a plurality of side filter screens to filter out solid materials from water passing therethrough along with an overflow grate to handle the flow that exceeds the capacity of the catch basket. The catch basket is held adjacent the weir with a pair of clips allowing for the quick removal for cleaning and replacement of the basket. A deflector plate is mounted beneath the curb inlet open grate for deflecting water passing through the grate into the catch basket.

4 Claims, 4 Drawing Sheets

CATCH BASIN FILTER FOR STORMWATER RUNOFF

This application claims benefit of 60/349,053 filed Jan. 15, 2002.

BACKGROUND OF THE INVENTION

The present invention is a catch basin filter for filtering storm water runoff as the storm water enters the catch basin. The present catch basin filter is designed for curb inlet catch basins having a ramp along the curb front to allow stormwater into the catch basin and which also allows water to enter through a grate covering the catch basin.

Storm water drain filters are installed within a storm water catch basin at the entrance to the catch basin to filter the stormwater runoff prior to it passing through a drain and out an outfall into a lake, pond, or retention area. The drain water which is frequently laden with trash, grass clippings, tree limbs, sand, gravel and other forms of sediment is collected from streets, parking lots, and other areas into a storm drain inlet where it is directed into a storm water drain pipe system. The drain water laden with trash and grass clippings, sand and gravel and frequently oil collected from streets is fed through a grated entrance into the storm water catch basin and then into a lake or retention pond or the like. The retention pond can tolerate a certain amount of grass clippings but cannot tolerate hydrocarbons generated from vehicles used in parking lots or along streets.

Prior art catch basin filter systems can be seen in the Shyh U.S. Pat. No. 5,284,580 for a refuse collecting frame for sewer. The frame is placed beneath a cover of a sewer drainage opening to accumulate refuse and permit easy disposal of the accumulated refuse and has a frame body with a filtering net on each side and a hole in the middle of the filtering net along the bottom of the frame body. The U.S. Pat. No. to Morris et al., 6,106,707, is a curb inlet storm drain system for filtering trash and hydrocarbons. A hopper is filled with a hydrocarbon absorbing material and is held between a bottom plate and an internal basket. The hopper is configured to be suspended in a storm drain adjacent to a curb inlet. The Williamson U.S. Pat. No. 6,287,459 is a drain water treatment system for use in a vertical passageway. The drain water treatment system is positioned within the vertical passageway of a drainage system and utilizes a catch basin for collecting the drain water. First and second filters containing a hydrophobic material are positioned within the filter supporting section for filtering contaminants from the drain water. The catch basin has an overflow permitting drain water to bypass the treatment system when it exceeds the rate of drainwater entering the system. The Sharpless U.S. Pat. No. 6,368,499 is a storm drain assembly with a disposable filter cartridge. The filter cartridge has a pillow structure containing oil absorbing fibers which is placed in a filter cage and is connected to the storm drain grate. The Barella U.S. Pat. No. 5,720,574 is a contaminant absorbing drainage trough that fits in a water drainage inlet and has a perforated bottom portion. The trough holds a replaceable filter medium. The Bamer et al. U.S. Pat. No. 5,820,762 shows a filter insert for a storm drain. The insert is filled with one or more bags of filter medium, such as absorbent celluose for absorbing oils and greases and hydrocarbons.

The present invention is added to a curb inlet catch basin found in some states of the United States which includes a ramp in the curb front which feeds into a catch basin to allow stormwater to run directly along the curb, down the ramp and into the catch basin. This type of catch basin also has a grated cover so that water can enter directly through the grate rather than through the ramped entrance. The present catch basin filter is designed to direct water both from the curb ramp inlet into the catch basin and directly through the grate for the catch basin into a catch basket filtering system prior to being fed into the catch basin and into a drain pipe.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
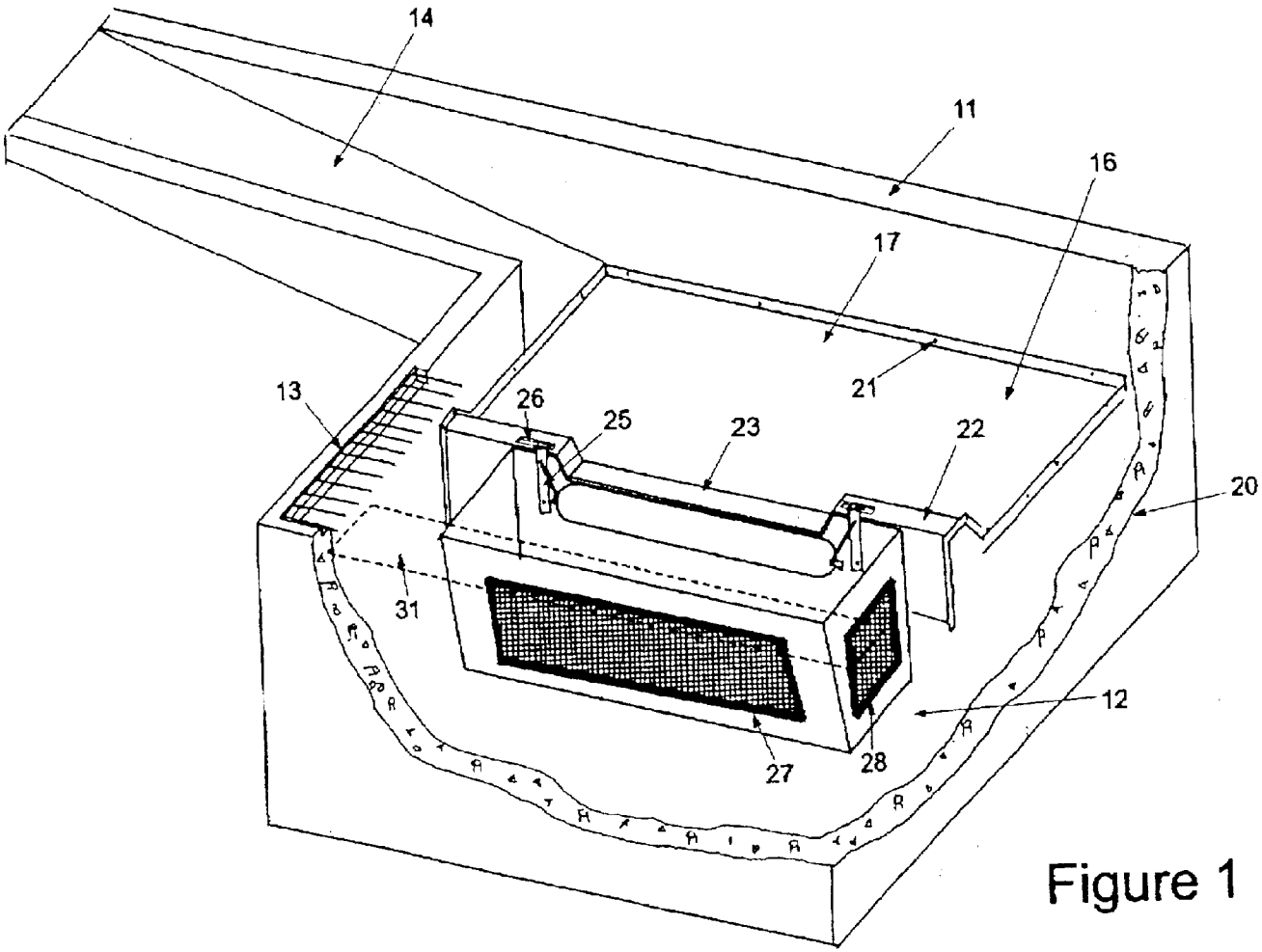
FIG. 1 is a perspective view of a stormwater catch basin with a curbed inlet having the present catch basin filter mounted therein.
Figure 2:
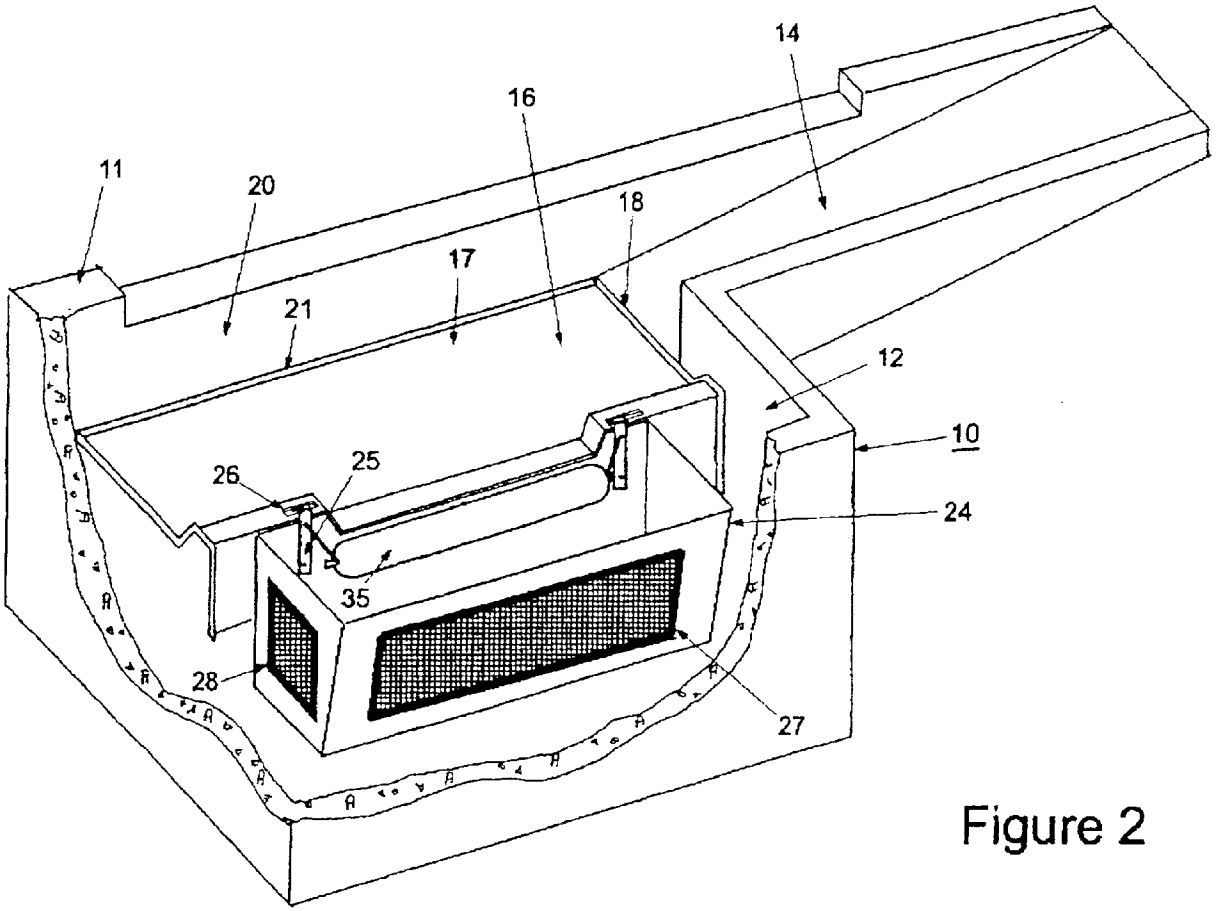
FIG. 2 is a perspective view of the catch basin and filter of FIG. 1 feeding from an opposite direction.
Figure 3:
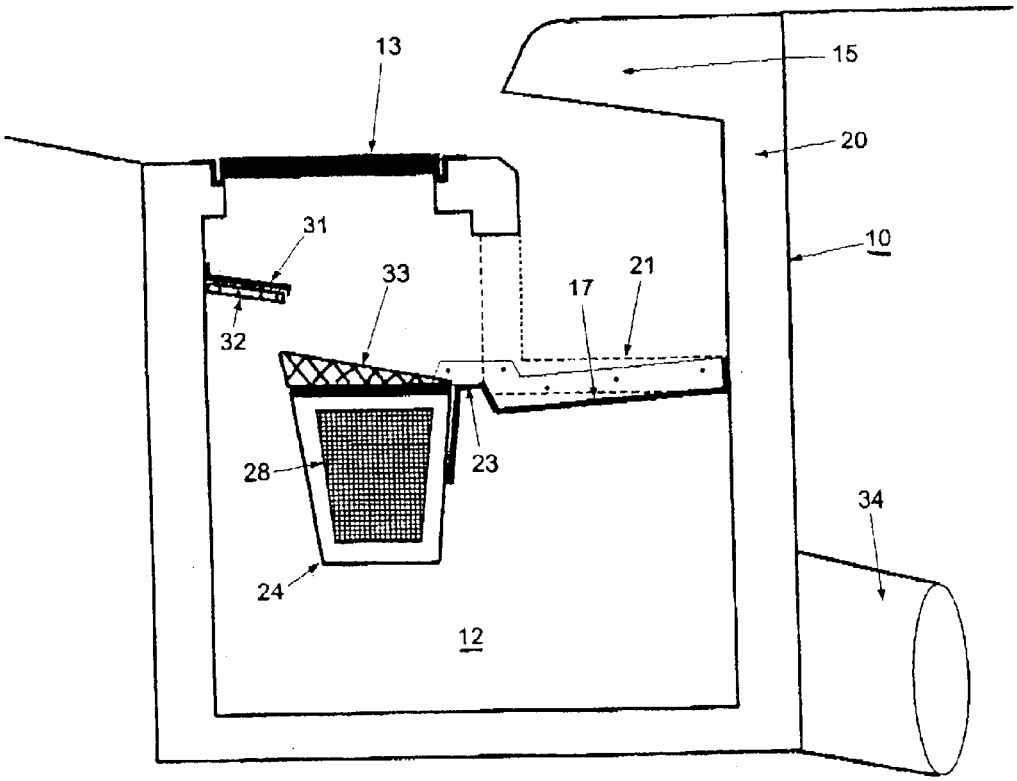
FIG. 3 is a sectional view of the catch basin of FIG. 2 showing the flow of water into the catch basin and through the basket filter system.

Referring to FIGS. 1–4, a conventional curb side catch basin 10 has a curb side 11 having a catch basin entrance 12 which is covered by a grate 13 as partially illustrated in FIG. 1. The catch basin has a stormwater runoff ramp inlet 14 feeding into the main catch basin 12. Catch basin 12 has a stormwater collection area. The curb inlet ramp 14 may be covered with a curb cover 15, as shown in FIG. 3. The stormwater catch basin curb inlet filter system 16 has a trough 17 positioned at the bottom 18 of the ramp 14 for catching water from the ramp 14. The trough 17 is attached to the walls 20 of the catch basin with a lip 21 and may be bolted or attached in any manner desired so that the walls 20 become the side of the trough area having the trough bottom 21. The front of the trough bottom 21 has a raised wall 22 forming a weir 23 which feeds the water from the trough 17 into the catch basket 24. The catch basket 24 is connected with clips 25 to openings 26 formed in the wall 22 so that it may be lifted out and emptied or cleaned and then hooked back into position, as shown in FIGS. 1 and 2. The catch basket 24 has filter screens 27 on the front thereof and 28 on the sides thereof and 30 on the bottom thereof.

Figure 4:
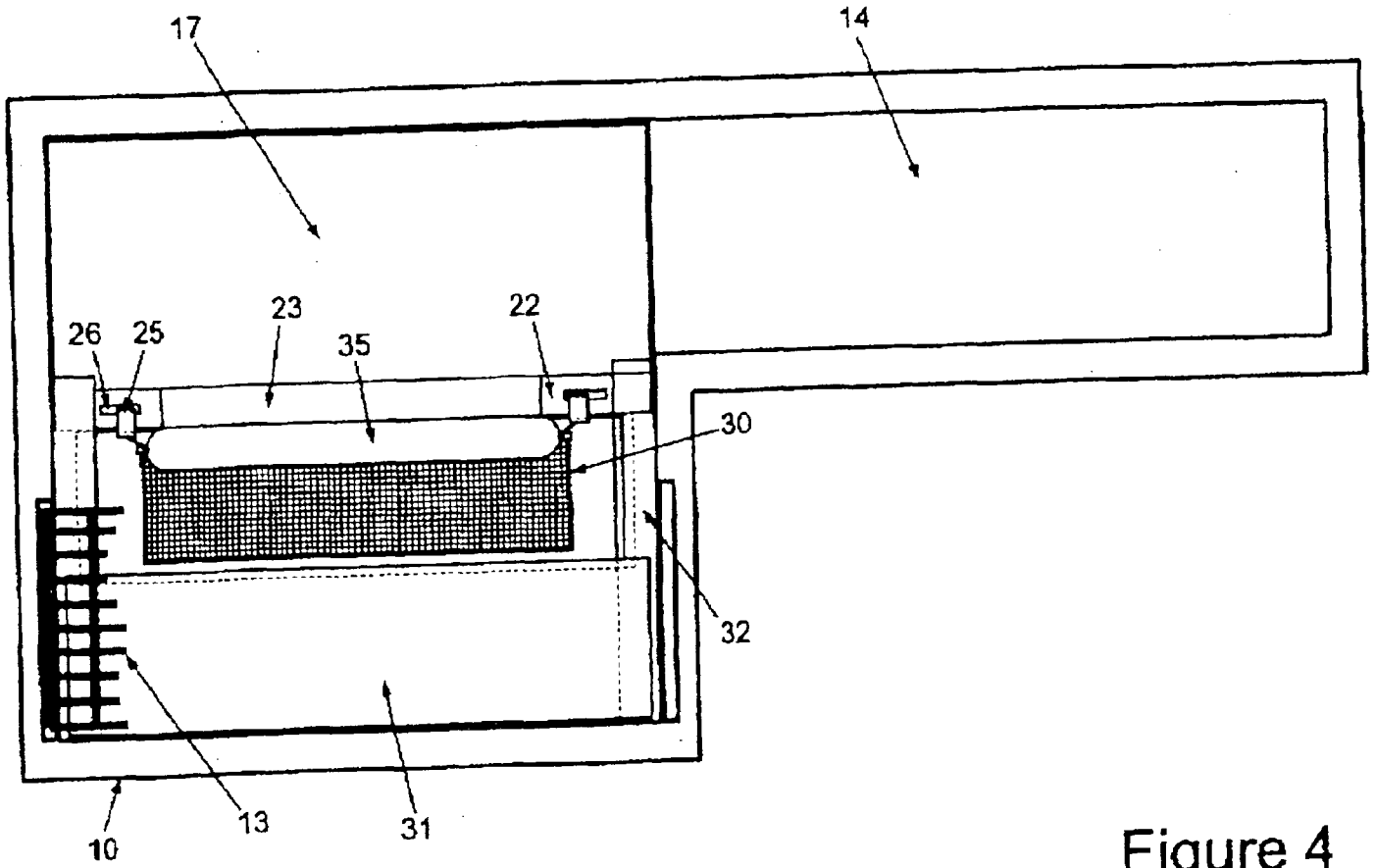
FIG. 4 is a top elevation of a filter system in accordance with FIGS. 1–3 mounted in a catch basin inlet and having an oil filtering boom mounted therein.

A hinged self 31 is supported on each end by the shelf holding batten 32 for deflecting water entering through the grate 13 into the catch basin 12 and directing the water into the catch basket 24. Catch basket 24 may also have an overflow screen 33 on the upper edge thereof having larger openings than the filter screens 27 and 28 so as to allow the overflow of water but still blocking large floating trash from entering the catch basin 12. The drain pipe 34 can feed directly into a retention pond, lake, or the like. As shown in FIGS. 2 and 4, an oil boom 35 may be attached across the front of the weir 23 in order to absorb any oil or hydrocarbons within the stormwater entering the basket 24.

In operation, the stormwater enters the curbside ramp 14 as well as through the grate 13, as shown in FIG. 3. The stormwater entering through the ramp 14 and collects in the trough 17. In addition, the water may flow over the ramp cover 15 and directly into the trough 17 where the stormwater accumulates until it flows over the weir 23 and over the oil boom 35 and into the filter basket 24. In addition, water passing through the grate 13 is deflected by the hinged deflector shelf 31 directly into the catch basket 24. The stormwater collecting in the catch basket 24 is then filtered through the stainless steel filter screens 27, 28 and 30 to collect various type of debris entering the catch basket. If the catch basket overflows, floating debris is captured by the screen 33. Periodically, catch basket 24 may be removed and emptied or cleaned by removing the grate 13 and grabbing the basket and lifting the basket with the hooks 26 off the side of the trough 17. An oil boom collector 35 has a fabric containing oil absorption materials which removes oil and hydrocarbons from the water by absorbing the hydrocarbons into the filter material. It can be replaced when cleaning the filter as desired or when it becomes saturated.

It should be clear at this time that a catch basin filter for a stormwater catch basin curb inlet has been provided which advantageously collects water entering in both a ramp and directly through the grate and allows for the easy removal and cleaning of the catch basket. However, the present invention is not to be construed as limited to the forms shown which are to be considered illustrative rather than restrictive.

I claim:

1. A filter system for a curb inlet catch basin having a curb ramp inlet and a top grate inlet for receiving storm water runoff comprising:

a trough mounted inside said curb inlet catch basin adjacent said curb ramp and having a raised wall for collecting runoff water therein;

a weir formed in a portion of said trough raised wall allowing water to run out of said trough;

an elongated hydrocarbon collecting boom removably attached adjacent said weir and positioned for said water runoff passing through said weir to pass thereover whereby said hydrocarbon collecting boom absorbs hydrocarbons from water passing thereover;

a catch basket removably mounted to said trough adjacent said weir and positioned to receive water runoff from said trough through said weir and over said hydrocarbon collecting boom, said catch basket having a bottom filter screen and a plurality of side filters screens to filter out solid materials from said water passing therethrough;

an overflow grate attached to said catch basket and positioned to allow overflow runoff therethrough; whereby storm water is collected in a trough and flows therefrom over a weir into a catch basket to treat and remove solid material from the water.

2. A filter system for a curb inlet catch basin in accordance with claim 1 in which said catch basket has a plurality of clips attached thereto for removably attaching said catch basket to said trough wall on either side of said weir.

3. A filter system for a curb inlet catch basin in accordance with claim 2 in which said trough wall has a plurality of openings therein for receiving said plurality of catch basket clips to removably support said catch basket to said trough adjacent said weir.

4. A filter system for a curb inlet catch basin in accordance with claim 3 in which said top grate inlet has a deflector plate mounted beneath said top grate to direct water passing through said top grate into said catch basin.

* * * * *